US005979028A

United States Patent [19]

Hicks et al.

[11] Patent Number: 5,979,028

[45] Date of Patent: Nov. 9, 1999

[54] SHOE LACE CLIP

[76] Inventors: Robert Hicks, 254 Riverview Trail, Roswell, Ga. 30075; Joseph E. Pittillo, 115 Ashmore Bridge Rd., Mauldin, S.C. 29662

[21] Appl. No.: 09/037,294

[22] Filed: Mar. 9, 1998

[51] Int. Cl.[6] ..... A43C 7/00; F16G 11/00

[52] U.S. Cl. ..... 24/712.9; 24/130; 24/712.1; 24/713.6

[58] Field of Search ..... 24/712.9, 712.1, 24/713, 713.6, 130, 3.13

[56] References Cited

U.S. PATENT DOCUMENTS

| | | | |
|---|---|---|---|
| Re. 12,147 | 8/1903 | Priddat | 24/130 |
| 509,707 | 11/1893 | Vachon | 24/712.1 |
| 656,431 | 8/1900 | Stewart | 24/130 |
| 757,820 | 4/1904 | Lykke | 24/130 |
| 1,531,410 | 3/1925 | Osterholt . | |
| 1,806,162 | 5/1931 | Hahn | 24/712.9 |
| 1,879,475 | 9/1932 | Poon | 24/712.9 |
| 2,650,399 | 9/1953 | Torelli | 24/117 |
| 3,066,370 | 12/1962 | Epstein | 24/117 |
| 3,500,508 | 3/1970 | Bennett | 24/117 |
| 3,675,276 | 7/1972 | Nuse | 24/130 |
| 3,897,163 | 7/1975 | Holmes | 24/130 |
| 4,178,661 | 12/1979 | Klein | 24/130 |
| 4,290,172 | 9/1981 | Burton | 24/117 |
| 4,879,787 | 11/1989 | Walls | 24/712.2 |
| 5,065,482 | 11/1991 | Lofy | 24/712.1 |
| 5,119,539 | 6/1992 | Curry | 24/712.1 |

FOREIGN PATENT DOCUMENTS

| | | | |
|---|---|---|---|
| 0192804 | 11/1957 | Austria | 24/712.1 |

*Primary Examiner*—Victor N. Sakran
*Attorney, Agent, or Firm*—Chapman and Cutler

[57] ABSTRACT

Laces of a shoe are secured against coming loose or untied in use by providing a simple clip through which the lace ends are easily threaded and then clamped. Each clip, formed as a thin plate, is carried atop a shoe, adjacent the knot which is tied conventionally in the lace ends. The clip has two holes through it, one generally atop the last eyelet in the row along each side of the tongue of the shoe. The clip also has two slots, spaced apart from each other and generally perpendicular to the line between the two holes. The walls of the slots are formed to constrict the space therein, so that a portion of a lace pulled sideways thereinto can move only if a comparatively great force is applied to it. The knot is tied above and atop the plate of the clip, in one form, and the free ends of the lace are secured in the slots in that form of use of the invention. In other forms of use, the lace ends are passed from the holes to the slots, being first crossed or not, and then the knot is formed along the top peripheral edge of the clip. Upper surfaces of the clips are exposed to view during use and so are available for team or advertising markings, logos, and colors. The clip is useful with athletic, casual, dress, childrens', and other shoes of all types.

22 Claims, 1 Drawing Sheet

SHOE LACE CLIP

FIELD OF THE INVENTION

The present invention relates to fasteners and particularly to securement devices for ends of laces and cords that are knotted together, as with bow knots.

BACKGROUND OF THE ART

Many devices have been proposed for helping to prevent laces of shoes from loosening and untying during use. Curry U.S. Pat. No. 5,119,539, issued in 1992, shows disk-form fasteners having spaced-apart holes with cuts or slots connecting with the holes for capturing the lace ends, assertedly avoiding the need then to tie the lace ends with any knot. Epstein U.S. Pat. No. 3,066,370 is similar and suggests multiple slots; Osterholt U.S. Pat. No. 1,531,410 uses angled slots for the same purpose. Torelli U.S. Pat. No. 2,650,399 and Burton U.S. Pat. No. 4,290,172 use only holes and no slots. Lofy U.S. Pat. No. 5,065,482 and Bennett U.S. Pat. No. 3,500,508 use complex tying arrangements and devices to avoid loosening of laces; Walls U.S. Pat. No. 4,879,787 uses Velcro™-type straps and offers space for a printed logo.

Flat shoe laces have now been replaced by round ones, and cotton materials by polyester and other synthetic materials with slippery surfaces. These newer laces are more difficult to keep tied, regardless of tightness and skill used in tying them.

Athletic games and events at all levels are still very often interrupted or delayed for participants to re-tie or tighten laces on their shoes. A need still exists for a simple, always-effective way of avoiding repeated loosening of shoe laces, particularly for instance in athletic events involving extensive footwork such as basketball, soccer, marathons, field hockey, lacrosse, and the like, but also for dress shoes, casual shoes, work boots, children's shoes, and the like.

SUMMARY OF THE INVENTION

The object of the present invention is to provide an inexpensive, simple to make and use, effective, and reliable fastening device to prevent ends of shoe laces, even new round and synthetic material laces, from loosening and untying under even the most rigorous conditions of use. This objective is met by a simple, generally flat clip formed, for instance, of a plate of medium-density polyethylene plastic. Two holes are formed through the plate along one axis for passing the ends of the lace freely. One or two elongated slots, constricted between opposing walls thereof, are formed from the periphery of the clip along an axis generally perpendicular to the line between the two holes. The plate of the clip may be permanently curved to match the top of the shoe at the place where the knot is normally tied between the ends of the laces.

In use, and according to the method of the invention, one end of the lace is threaded through each of the holes in the clip. In one form of use, the knot is tied immediately atop the clip where the lace ends emerge from the holes, and the further ends of the laces are captured in the slot or slots immediately as they emerge from the knot. The lace ends, being stabilized by the constricting slot(s), will not tend to pull free from the knot and thus to loosen the bow knot and the lacing of the shoe. In another form, the lace ends are captured in the slot(s) immediately after the lace ends emerge from the holes in the clip; the constricting slot(s) themselves serve to hold the laces tight and prevent loosening, but the further ends of the lace will preferably be brought under the top edge of the clip and tied in a conventional bow knot there. The exposed ends can be passed again throught the slot(s), if desired. Either method of tying and securement leaves much of the surface of the clip unobstructed, for display of a desired logo or color of a team or merchant to be printed thereon, directly or via a sticker, or integrally molded therein. Other methods can also be used, such as having the slot directed toward the toes of the shoe, and other lacing and knotting methods can be used according to the invention. The perimeter of the plate of the clip may have any desired shape, whether functional or to conform to a logo, character, animal, or other figure desired.

THE PREFERRED EMBODIMENTS

Figure 1:
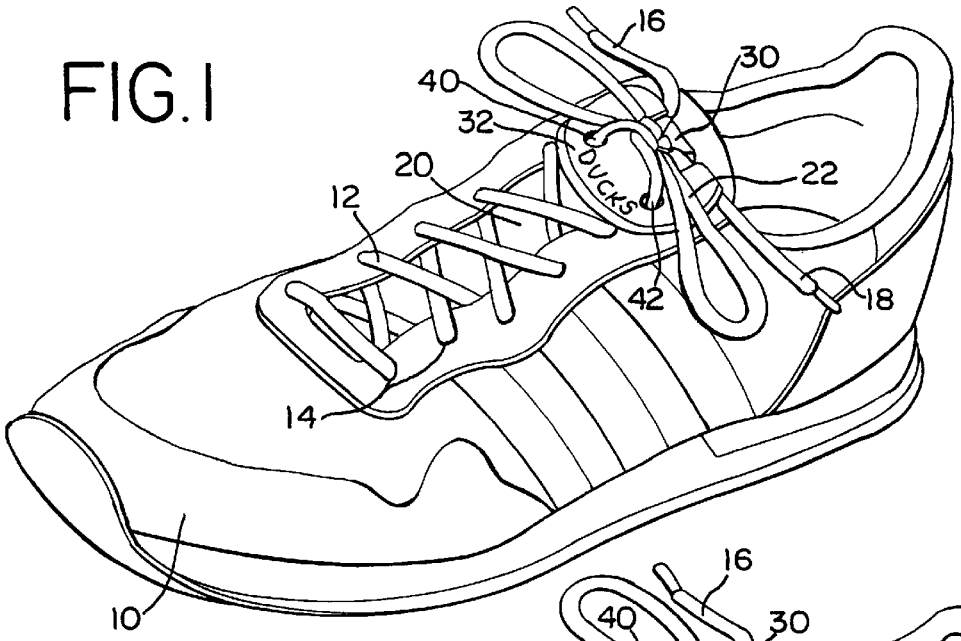
FIG. 1 hows an athletic shoe with the clip of the invention in use thereon, with the knot formed he clip and ends of the lace passed thereafter through the slots.

A shoe 10 has a lace 12 of any desired form, round or flat, and of any convenient materials, threaded through eyelets 14 of the shoe with ends 16, 18 of approxirnately equal lengths left loose, initially, at the topmost of the eyelets 14. Pulling the ends 16, 18 of the lace tight through the eyelets pulls the left and right upper parts of the shoe 10 above a tongue 20 together, tightening the shoe about the foot of a user (not shown). Tying the ends 16, 18 of the lace 12 together in a knot 22 (or 24 in FIG. 2) secures the shoe 10 to the foot of the user and maintains a desired tightness of the lace 12 in the eyelets 14. The shoe 10 is shown as an athletic or casual shoe, but the invention is useful with all other shoes including dress shoes, other casual shoes, work shoes, children's shoes, infant shoes, etc.

This tightness of the lace 12 provides selected tightness and security of the shoe 10 on the user's foot—until the knot loosens or comes undone, either intentionally by the user or by itself. If a knot loosens unexpectedly during use, the shoe 10 loosens and adverse athletic performance and personal comfort result; re-tying the lace often requires stopping the game or other activity, being delayed in a timed event, and the like. Re-tying a shoe during a lull in the game or other activity is at least a distraction from more pressing concerns. A loose lace in a dress shoe can be seen as ill-grooming; and a loose lace in a work shoe or boot can be hazardous to the health and life of the user. A bow knot should stay tied and not loosen during use or until the lace end is intentionally pulled through the knot. As is well known, however, tying a knot tightly and well does not always avoid loosening—particular with round and/or synthetic material laces—from stresses imposed on the shoe and lace during use. Even professional athletes at the highest levels are often seen retying their shoes.

A shoe lace securement clip 30 according to the present invention overcomes these problems with inadvertent loosening of laces on shoes even during rigorous athletic use. The clip 30 is formed of a plate of relatively thin, perhaps 0.125 inch thick, medium density plastic, such as polyethylene plastic, so it can capture lace ends and hold them firmly, but it is not so hard as to cut or chafe the lace ends or to be a danger to anyone if it is fallen upon or snagged. The clip 30 is preferably formed in a slightly convex shape as shown, to fit the upper curvature of a shoe 10 on which it is used, and to ensure that it lies closely against the top of the shoe when the lace ends 16, 18 are snubbed up in it.

The clip 30 may be of any convenient size and shape, but 1.25 inches across and 0.75 inch high in a kidney or oval shape are desirable dimensions fitting many shoes. This size and shape as shown also provides space on its upper surface for logos such as for teams 32, 34 or for advertisers 36, as discussed below.

Two holes 40, 42 are formed in the clip 30 as shown for passing the lace ends 16, 18 relatively freely therethrough. The holes 40, 42 are spaced apart across the plate of the clip 30, and will overlie the topmost of the eyelets 14 on the shoe with which the clip 30 is to be used, when the lace is tightened for use of the shoe. The spacing of the holes 40, 42 is believed not to be critical, and one size should fit most all adult shoes, although other sizes can be provided. No particular form is required of these holes, and they may be laterally elongated, but the edges should be smooth so the lace ends 16, 18 passing through them are not chaffed or cut by the plastic.

At least one, and preferably two slots 50, 52 are also formed in the clip 30 generally as shown. The slot extends from an opening at a periphery 54 of the clip toward a line extending between the holes 40, 42. The slot or slots may extend perpendicularly to that line. Two slots may be spaced to extend parallel to one another, but splaying them together or apart toward the periphery 54 may also be advantageous to use and is in accord with the invention.

Figure 4A:
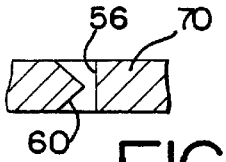
FIGS. 4A and 4B show sectional views of alternate forms of the slots in the plate.
Figure 4B:
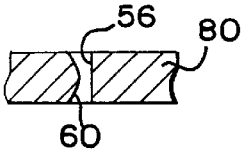
Figure 3:
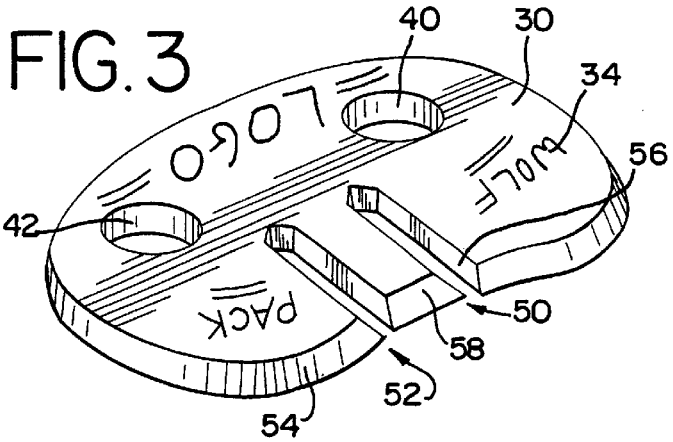
FIG. 3 shows a detail, perspective view of the clip of the invention in one form.

Each slot 50, 52 is formed with walls 56, 58 which are variably spaced apart from one another through the thickness of the clip 30, so as to increase the holding pressure on the lace ends 16, 18. This variable spacing may be provided by slanting one or both walls as shown, or by forming one or both walls 56, 58 with a "V" or "U" shape with the point of the shape extending toward the opposing wall, as depicted in walls 60 and 62 in clips 70, 80 respectively, in FIGS. 4A and 4B, and in other ways.

The plastic of the clip 30 is preferably a medium-density polyethylene, but any suitable material can be used. The clip should be relatively hard so that it grabs the lace ends 16, 18 in the slots 50, 52 between the walls 56, 58 thereof, even for round and synthetic-material laces, but not so hard as to cut or chafe the laces after repeated use. The plastic should be able to be brightly colored, as in team colors, and even having multiple colors in a single clip where appropriate without weakening the structure of the plate. The surface of the plastic clip 30 should be imprintable with the logos 32, 34, or 36 as shown, or the logos can be molded into the plastic as may be appropriate. Stickers, removeable or not, can also be used. The surface need not be smooth but can have features molded or stamped into the plastic without departing from the principles of the invention. The periphery 54 of the plate of the clip can be rounded as shown or configured as a logo, a character, an animal, or in any other design and size desired.

In use, the ends 16, 18 of the lace 12 on the shoe 10 are threaded end-wise through the holes 40, 42 in the clip 30. With the shoe 10 on a user's foot, the ends 16, 18 are pulled tight past the clip 30, to bring the two upper sides of the shoe 10 together and the lace 12 tight through all the eyelets 14, as is well known. The clip 30 then is brought down against the top of the shoe as shown. In one manner of use of the invention, a bow knot 22 is tied in the normal way upon the upper surface of the clip 30, as depicted generally in FIG. 1. Then the ends 16, 18 of the lace 12 are passed sidewardly into the slot(s) 50, 52, respectively, and portions of the ends near the knot 22 are captured between the walls 56, 58 of those slot(s) and held there. This capture of the ends 16, 18 of the lace prevents the flopping of those ends during use from exerting pulling forces on the knot 22 so that the ends pull through the knot and loosen same inadvertently during use. However, the ends 16, 18 still can be grasped when desired by the user and pulled from the slots 50, 52, or through those slots, when it is time to untie the shoe lace for loosening of the lace or removal of the shoe from the user's foot.

Figure 2:
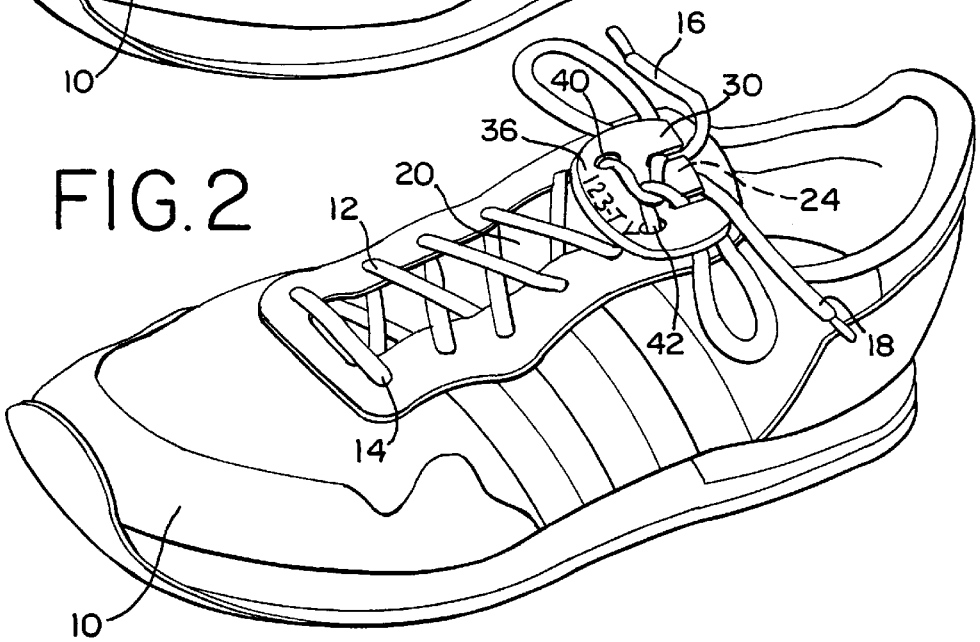
FIG. 2 shows an athletic shoe with the clip of the invention in use thereon, with the ends of the lace passed first through the slots and a knot formed above and behind the clip.

In another manner of use of the invention, the ends 16, 18 of the lace 12 are passed through one or each of the slots 50, 52 prior to being knotted together in a bow knot beneath the plate, as at 24. The lace ends 16, 18 can be pulled tight and then either passed immediately into the slot, or crossed over the surface of the clip 30 into the opposing slot, or looped with the other lace end as shown and then passed into the adjacent slots, as shown. The walls 56, 58 of each slot 50, 52, or the alternative walls 60, 56 or 62, 56, then are the principal holding force for the lace 12, supplemented by the knot 24 tied beneath the clip surface 30 as shown in FIG. 2. This manner of use leaves much more of the surface of the clip 30 exposed to view, for use in displaying team or advertising messages thereon and should be just as secure against loosening of the lace 12 as the first manner of use, noted above.

Many variations may be made in the clip shown and its manner of use without departing from the principles of the invention as pictured and described herein and claimed as our invention. For instance, the clip may be formed in nearly any shape in the periphery of its plate, and in most any size, without avoiding the invention. The clip may be rotated 180 degrees for use, with the slot(s) directed toward the toes rather than the ankle of the user. The invention resides broadly in the arrangements of the holes and slot(s) in the clip as disclosed and recited in the claims. Minor variations will not avoid the use of the invention.

We claim as our invention:

1. A securement clip for ends of a lace on a shoe, the shoe being securable upon a user's foot by a knot tied in said ends of said lace, and the lace having two said ends formable into said knot, wherein the clip comprises:

a thin plate adapted to be carried atop said shoe adjacent said knot;

the plate forming two apertures therein spaced apart along an axis generally transverse to that of the shoe, each said aperture being sized to pass freely one end part of said lace; and the plate also forming at least one constricted slot spaced entirely from and not intersecting with said apertures and having side walls extending through the plate, and each said slot being sized to pass but releasably hold in clamped relation therein between said walls said end part of said lace adjacent said knot.

2. A securement clip as defined in claim 1, wherein the thin plate is formed with a permanent convex shape for fitting closely atop said shoe.

3. A securement clip as defined in claim 1, wherein the thin plate is formed of a flexible plastic material.

4. A securement clip as defined in claim 1, wherein the thin plate is formed of a medium density polyethylene plastic.

5. A securement clip as defined in claim 1, wherein each said slot in the thin plate is constricted by at least one of the sides of said slot sloping uniformly toward the other between the upper and the lower surfaces of said plate.

6. A securement clip as defined in claim 1, wherein each said slot in the thin plate is constricted by part of one wall angling toward the other wall.

7. A securement clip as defined in claim 1, wherein each said slot in the thin plate is constricted by at least one of the side walls of each said slot curving toward the other between the upper and the lower parts of said plate.

8. A securement clip as defined in claim 1, wherein two of said slots are formed in said plate.

9. A securement clip as defined in claim 8, wherein said two slots are formed to extend in a direction perpendicular to a line between said two holes in said plate.

10. A method of securing a knot in ends of a lace of a shoe from loosening inadvertently during use, employing a thin plate with two holes and, separately from said holes and not intersecting with said two holes, at least one constricting slot formed therein, the method comprising the steps of:

bringing the two ends of the lace through said respective holes in said plate in a position atop the shoe and adjacent the position of a knot to be formed therein;

tying a knot in the ends of the lace to join said ends together firmly; and passing the ends of the lace sidewardly through the slot formed in the plate.

11. The method defined in claim 10 wherein the step of tying a knot occurs before the step of passing the ends of the lace through said slot.

12. The method defined in claim 10, wherein the step of tying a knot occurs after the step of passing the ends of the lace through said slot, and wherein the ends of the lace are joined under the plate for tying said knot therein.

13. The method defined in claim 10, wherein the knot is tied adjacent a peripheral edge of said plate adjacent the slot.

14. The method defined in claim 10, wherein the plate is formed with two slots and the ends of the lace cross one another after passing through the holes in the plate and before passing through the slots.

15. The method defined in claim 10, wherein the plate is oriented in use so the slot opens toward the ankle of the user.

16. A retaining clip for ends of a lace of a shoe, wherein the clip comprises:

a generally flat, thin plate of flexible material having an outer periphery;

surfaces forming a pair of apertures through the plate, the apertures spaced inwardly from said periphery and apart from one another, each said aperture being sized to pass one of said lace ends endwardly therethrough; and surfaces forming at least one slot through the plate, said one slot opening to the periphery of the plate and not intersecting either of said apertures, and the surfaces of said one slot constricting the opening of the slot so as to releasably engage a portion of at least one of the ends of the lace.

17. A retaining clip for ends of a lace of a shoe as defined in claim 16, wherein two of said slots are provided and the slots are formed parallel to one another and perpendicular to a line between the two apertures through the plate.

18. A retaining clip for ends of a lace of a shoe as defined in claim 16, wherein at least one of the slots is formed with one wall which is angled toward the other wall thereof.

19. A retaining clip for ends of a lace of a shoe as defined in claim 16, wherein at least one of the slots is formed with one wall which is angled uniformly throughout its depth toward the other wall.

20. A retaining clip for ends of a lace of a shoe as defined in claim 16, wherein at least one of the slots is formed with one wall having a surface curving toward the other wall.

21. A retaining clip for ends of a lace of a shoe as defined in claim 20, wherein one of the slots is formed with at least one wall having a surface curving uniformly toward the other wall.

22. A retaining clip as defined in claim 16, wherein the periphery of the clip has a convex rounded form.

* * * * *